United States Patent [19]

Tyrer et al.

[11] 4,174,412

[45] * Nov. 13, 1979

[54] STRUCTURES AND STRUCTURAL MEMBERS MADE WHOLLY OR PARTLY OF WOOD

[75] Inventors: Richard G. Tyrer, Liverpool; James Milne, Cumbria, both of England

[73] Assignee: Balfour Beatty Limited, Surrey, England

[ * ] Notice: The portion of the term of this patent subsequent to Dec. 6, 1994, has been disclaimed.

[21] Appl. No.: 837,438

[22] Filed: Sep. 28, 1977

[30] Foreign Application Priority Data

Sep. 29, 1976 [GB] United Kingdom ..... 40380/76

[51] Int. Cl.[2] ..... B05D 3/00; B05D 7/06

[52] U.S. Cl. ..... 427/297; 427/346; 427/440

[58] Field of Search ..... 427/297, 296, 397, 440, 427/441, 298, 294; 52/515, 744, 514, 743, 517; 21/7, 63; 118/50, 50.1; 405/216; 422/292

[56] References Cited

U.S. PATENT DOCUMENTS

| | | | |
|---|---|---|---|
| 2,875,020 | 3/1959 | Ring | 427/297 |
| 3,467,546 | 9/1969 | Page | 427/297 |
| 3,595,182 | 7/1971 | Clapp | 427/297 |
| 3,779,797 | 12/1973 | Makinen | 427/297 |
| 3,834,329 | 9/1975 | Suggitt | 427/297 |
| 3,987,219 | 10/1976 | Arvidsson | 427/297 |
| 4,060,953 | 12/1977 | Milne | 427/297 |

*Primary Examiner*—Morris Kaplan

*Attorney, Agent, or Firm*—Buell, Blenko & Ziesenheim

[57] ABSTRACT

A wooden part of a structure or structural member, e.g. a telegraph pole, that is exposed to the atmosphere is impregnated with wood preservative by a vacuum impregnation process. The exposed wooden part of the pole is surrounded by a closely fitting, fluid-impermeable covering, e.g. a polythene shroud, and boundary edges of the covering are sealed to form a substantially fluid-tight enclosure. Air and any other fluid is evacuated from voids in the said wooden part of the pole and from within the fluid-tight enclosure and wood preservative in a flowable state is allowed to enter the enclosure and the voids in said wooden part of the pole until said wooden part is fully impregnated with wood preservative.

14 Claims, 1 Drawing Figure

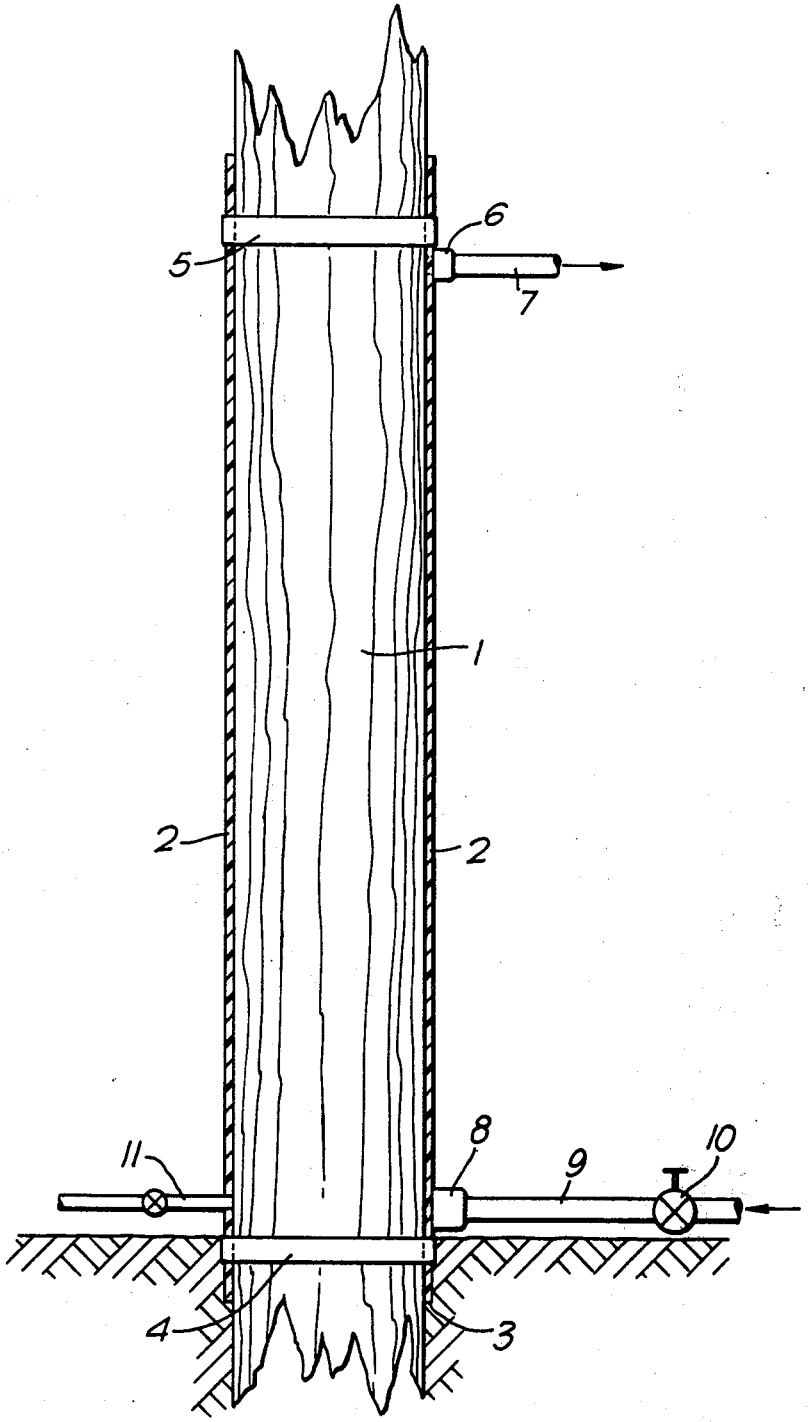
6
5
7
1
2
2
11
8
9
10
4
3

STRUCTURES AND STRUCTURAL MEMBERS MADE WHOLLY OR PARTLY OF WOOD

This invention relates to the preservation of structures and structural members made wholly or partly of wood and is particularly concerned with preservation in situ of at least that wooden part of a structure or structural member that is exposed to the atmosphere and may be subjected to extremes of weather conditions.

For many years it has been the general practice to preserve wooden poles from deterioration otherwise caused by damp by impregnating the pole with creosote or other suitable wood preservative. Such impregnation with wood preservative can be effected before or after a pole is erected but, for obvious reasons, it is normal practice to impregnate thoroughly with wood preservative the whole or a part of a pole before the pole is erected. However thoroughly such impregnation is carried out, in the course of time the effectiveness of the wood preservative in a pole gradually diminishes and it is necessary to re-impregnate at least that part of the erected pole that is exposed to the atmosphere.

It is an object of the present invention to provide a simple and inexpensive method of impregnating with wood preservative at least a wooden part of a structure or structural member that is exposed to the atmosphere.

According to the invention the method comprises surrounding said exposed wooden part of the structure or of the structural member by a closely fitting, fluid-impermeable covering and sealing boundary edges of the covering to form a substantially fluid-tight enclosure; evacuating air and any other fluid from cracks and any other voids in said wooden part of the structure or structural member and from within the fluid-tight enclosure; and allowing wood preservative in a liquid or other flowable state to enter the enclosure and the cracks and other voids in said wooden part of the structure or structural member until said wooden part of the structure or structural member is fully impregnated with wood preservative.

Preferably, wood preservative is not allowed to enter the fluid-tight enclosure until the enclosure and voids in said wooden part of the structure or structural member enclosed therein have been substantially evacuated.

The method of the present invention is especially suitable for impregnating with wood preservative that part of a telegraph pole, mast, post or similar upright wooden structural member that is exposed to the atmosphere but it can be employed in impregnating any other from of erected wooden structure or structural member, for instance a wooden fence.

Where the wooden part of the structure or structural member is substantially higher than the head of wood preservative that the means for evacuating air can support or, in other circumstances, said wooden part may be treated in two or more sections located one above the other.

The closely-fitting, fluid-impermeable covering may be formed wholly by a flexible shroud or, in some circumstances where the structure or structural member has a surface or surfaces of a shape or configuration that makes it difficult to envelop such surface or surfaces in a closely-fitting shroud, for instance where a surface of the structure or structural members has another structural member or other structural members upstanding from or projecting outwardly from the surface, the closely-fitting, fluid-impermeable covering may be formed at least in part by applying to an exposed surface or exposed surfaces of the structure or structural member a continuous layer of hardenable material in a liquid or semi-liquid state which, on setting, forms a closely-fitting, fluid-impermeable coating.

Where the closely-fitting, fluid-impermeable covering consists of or comprises a flexible shroud, in order that progress of the impregnating operation can be observed at all times and that the supply of wood preservative can be cut off as soon as said wooden part of the structure or structural member has been fully impregnated, the shroud is preferably formed of a transparent material.

Boundary edges of the flexible shroud may be sealed by means of a coating of resin or other hardenable material or by means of adhesive tape.

Evacuation of the substantially fluid-tight enclosure is preferably effected by at least one vacuum pump and/or at least one air compressor and associated venturi suction ejector. Preferably the or each vacuum pump or air compressor and associated venturi suction ejector is connected to an outlet or outlets in an upper part of the closely-fitting, fluid-impermeable covering and at least one source of wood preservative in a liquid or other flowable state is connected to an inlet or inlets at a lower part of the covering so that the preservative flows upwardly within the enclosure.

Where the structure or structural member is erected with a lower part of the structure or structural member embedded in the ground, preferably the closely-fitting, fluid-impermeable covering is arranged to extend below ground level in order to ensure that that wooden part of the structure or structural member immediately adjacent the ground and immediately below ground level will be fully impregnated with preservative.

Where the structure or structural member consists of or includes a pole having a wooden part that is buried in the ground, the buried wooden part of the pole may be impregnated with wood preservative by the method described and claimed in the Complete Specification of our British Pat. No. 1,454,917.

To ensure that the enclosed wooden part of the structure or structural member is substantially fully impregnated with wood preservative throughout its thickness, the wood preservative may be forced into said wooden part at a pressure above atmospheric pressure. Effective impregnation of said wooden part may be further enhanced by subjecting the or each stream of wood preservative being introduced under pressure into said wooden part to a hammer effect, for instance by means of a reciprocating piston working in a cylinder connected in a branch in the flow path between the source of wood preservative and the inlet.

To reduce the risk that small bubbles of air or other fluid may be trapped in the closed ends of cracks or other voids or may cling to the boundary surfaces of cracks or other voids in said wooden part of the structure or structural member, should the state or nature of the structure or structural member permit, the wooden part may be subjected to vibration effectively to shake out any such bubbles. Such vibration may be either manually or mechanically applied.

The wood preservative is preferably creosote or other chemical preservative which soaks into and impregnates the material of which the structure or structural member is made.

The invention is further illustrated by a description, by way of example, of the preferred method of impregnating with wood preservative that part of an erected wooden telegraph pole that is exposed to the atmosphere, with reference to the accompanying drawing, which shows a fragmental cross-sectional side view of the pole.

The figure of drawing shows means to practice the invention.

Referring to the drawing, the erected wooden telegraph pole 1 that is to be impregnated with creosote is treated in two or more sections located one above the other to limit the head of creosote that the vacuum pump or pumps has or have to support. The lowermost section of the pole is first treated by wrapping a sheet 2 of transparent plastics material around said lowermost section and sealing the overlapping edges of the sheet with adhesive tape. The bottom edge 3 of the sheet 1 extends below ground level and the sheet is sealed to the pole adjacent its bottom edge by adhesive tape 4; the sheet is sealed to the pole adjacent its top edge by adhesive tape 5. Attached to and projecting from an upper part of the sheet 2 is an outlet fitting 6 to which can be connected a pipe for connection to a liquid trap (not shown) and vacuum pump (not shown). An inlet fitting 8 is attached to and projects outwardly from a lower part of the sheet 2 and this fitting is connected by a pipe 9 to a source of creosote (not shown). A tap 10 is provided in the pipe 9 connected to the creosote source.

In operation, the tap 10 connected in the pipe 9 is closed and air and any other fluid is evacuated from the substantially fluid-tight enclosure formed by the sealed sheet 2 and from the enveloped lowermost section of the wooden pole 1. When a satisfactory level of vacuum has been reached the tap 10 is opened and creosote is drawn upwardly into the enclosure to impregnate the enveloped section of the pole 1 until it appears at the outlet 6. At this juncture the tap 10 is closed and the vacuum pump is switched off. After the enveloped section of the pole 1 has been allowed to soak in creosote remaining in the fluid-tight enclosure, a drain 11 at the lower end of the sheet 2 is opened to permit excess creosote in the fluid-tight enclosure to be drained off. The sheet 2 is then removed and the next section of the pole 1 is treated in a similar manner until the entire length of the pole has been impregnated with creosote.

What we claim as our invention is:

1. A method of impregnating with wood preservative at least a wooden part of a structure that is exposed to the atmosphere, which method comprises surrounding said exposed wooden part of the structure by a closely fitting, fluid-impermeable covering and sealing boundary edges of the covering to form a substantially fluid-tight enclosure; evacuating air and any other fluid from cracks and any other voids in the said wooden part of the structure and from within the fluid-tight enclosure; and allowing wood preservative in a flowable state to enter the enclosure and the cracks and other voids in said wooden part of the structure until said wooden part of the structure is fully impregnated with wood preservative.

2. A method as claimed in claim 1, wherein the closely fitting, fluid-impermeable covering is formed in part by at least one flexible shroud.

3. A method as claimed in claim 2, wherein the flexible shroud is of transparent material.

4. A method as claimed in claim 2, wherein boundary edges of the flexible shroud are sealed to the structure by a coating of hardenable material.

5. A method is claimed in claim 2, wherein boundary edges of the flexible shroud are sealed to the structure by means of adhesive tape.

6. A method as claimed in claim 1, wherein air and any other fluid is evacuated through at least one outlet in an upper part of the covering and wood preservative enters the enclosure through at least one inlet in a lower part of the covering.

7. A method is claimed in claim 1, wherein said wooden part of the structure is treated in at least two sections located one above the other.

8. A method as claimed in claim 1, wherein wood preservative is not allowed to enter the fluid-tight enclosure until the enclosure and cracks and other voids in said wooden part of the structure enclosed therein have been substantially evacuated.

9. A method as claimed in claim 1, wherein wood preservative is forced into said wooden part of the structure at a pressure above atmospheric pressure.

10. A method as claimed in claim 9, wherein the stream of wood preservative being introduced under pressure into said wooden part is subjected to a hammer effect.

11. A method as claimed in claim 1, wherein said wooden part of the structure is subjected to vibration effectively to shake out any bubbles of air trapped in the closed ends of blind cracks and other blind voids or clinging to the boundary surfaces of cracks and other voids.

12. A method of impregnating with wood preservative that part of an upright wooden pole that is exposed to the atmosphere, which method comprises surrounding at least a section of said exposed part of the pole by a closely fitting, fluid-impermeable flexible shroud and sealing boundary edges of the shroud to form a substantially fluid-tight enclosure; evacuating air and any other fluid from cracks and other voids in said section of said part of the pole and from within the fluid-tight enclosure; and allowing wood preservative in a flowable state to enter the enclosure and the cracks and other voids in said section of said part of the pole until said part is fully impregnated with wood preservative.

13. A method as claimed in claim 12, wherein said wooden part of the pole is treated in at least two sections located one above the other.

14. A method as claimed in claim 12, in which a lower section of the wooden part of the pole is embedded in the ground, wherein the closely fitting, fluid-impermeable flexible shroud is arranged to extend below ground level.

* * * * *